US005139004A

United States Patent [19]

Gose et al.

[11] Patent Number: 5,139,004

[45] Date of Patent: Aug. 18, 1992

[54] IGNITION SYSTEM FOR A SPARK IGNITED INTERNAL COMBUSTION ENGINE

[75] Inventors: Mark W. Gose; Scott B. Kesler, both of Kokomo, Ind.

[73] Assignee: Delco Electronics Corporation, Kokomo, Ind.

[21] Appl. No.: 765,086

[22] Filed: Sep. 25, 1991

[51] Int. Cl.[5] ..... F02P 3/05; F02P 3/045

[52] U.S. Cl. ..... 123/644; 123/609

[58] Field of Search ..... 123/609, 610, 611, 623, 123/644, 651, 652

[56] References Cited

U.S. PATENT DOCUMENTS

| | | | |
|---|---|---|---|
| 3,838,672 | 10/1974 | Richards et al. | 123/644 |
| 3,854,466 | 12/1974 | Steinberg et al. | 123/618 |
| 4,041,912 | 8/1977 | Sessions | 123/611 |
| 4,064,415 | 12/1977 | Blackington | 123/644 X |
| 4,082,075 | 4/1978 | Davis | 123/609 |
| 4,106,447 | 8/1978 | West | 123/425 |
| 4,176,644 | 12/1979 | Hellberg et al. | 123/618 |
| 4,248,200 | 2/1981 | Sugiura et al. | 123/644 |
| 4,329,970 | 5/1982 | Mowery | 123/618 |
| 4,402,299 | 9/1983 | Nakao et al. | 123/644 X |
| 4,799,471 | 1/1989 | Lasagna et al. | 123/644 |
| 4,899,715 | 2/1990 | Koiwa et al. | 123/644 |
| 4,977,883 | 12/1990 | Koiwa | 123/644 |

FOREIGN PATENT DOCUMENTS

| | | | |
|---|---|---|---|
| 134126 | 11/1978 | Japan | 123/644 |

*Primary Examiner*—Willis R. Wolfe

*Attorney, Agent, or Firm*—Creighton R. Meland

[57] ABSTRACT

An ignition system for a spark-ignited internal combustion engine has a transistor connected in series with the primary winding of an ignition coil. The transistor is switched ON and OFF in synchronism with rotation of the crankshaft of the engine. Primary winding current is sensed by a resistor and the voltage developed across the resistor is fed back into an error amplifier which causes the transistor to be biased into a current-limiting mode when primary winding current increases to a predetermined level. The feedback loop has a capacitor which is a feedback compensation element. This capacitor, together with a resistor form an RC timing circuit which is operative at times to prevent the transistor from being biased back ON for a predetermined time period after it has been biased OFF.

3 Claims, 2 Drawing Sheets

IGNITION SYSTEM FOR A SPARK IGNITED INTERNAL COMBUSTION ENGINE

Figure 1A:
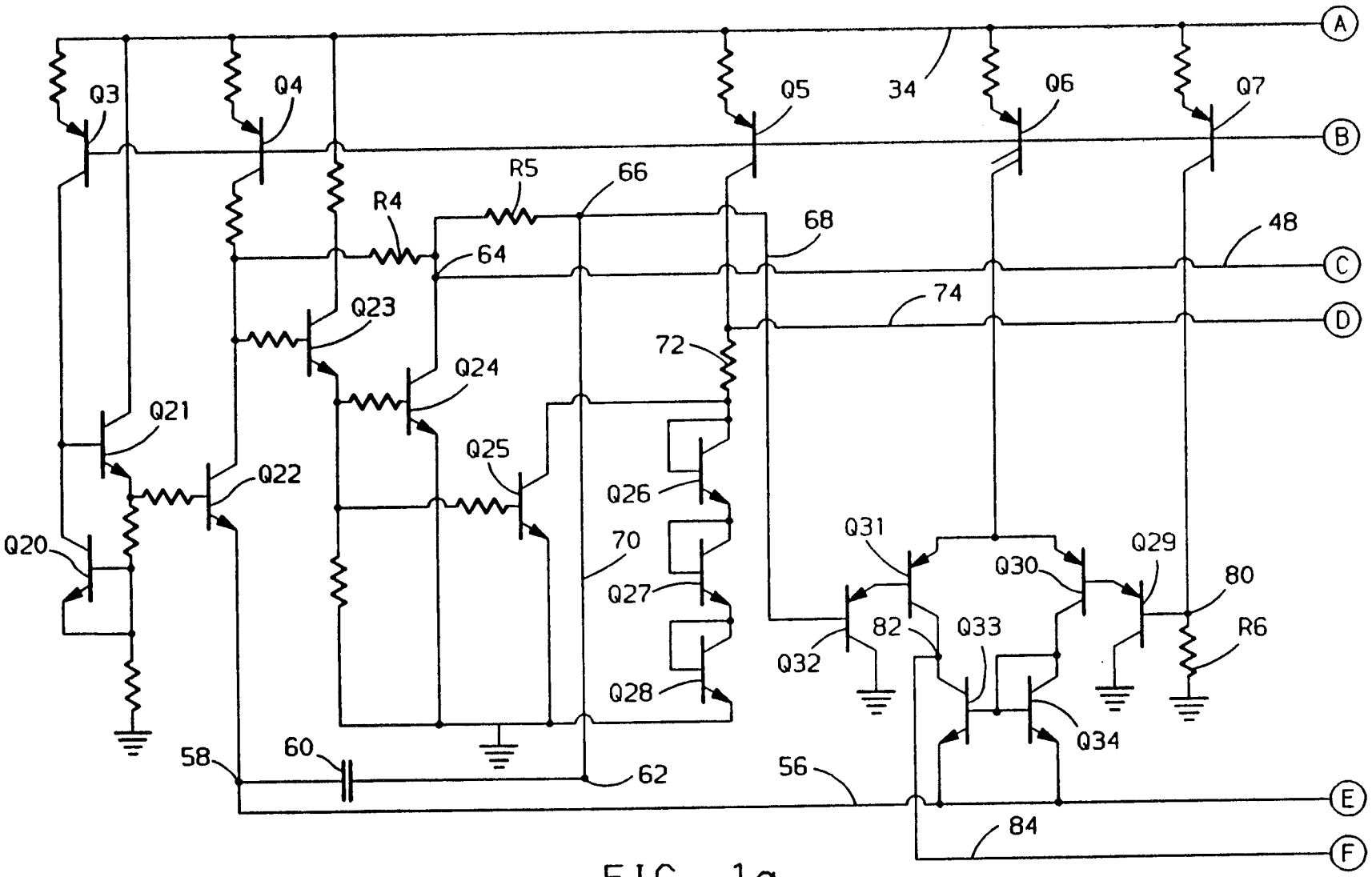

This invention relates to electronic ignition systems for spark-ignited internal combustion engines.

Electronic ignition systems that utilize a transistor connected in series with the primary winding of an ignition coil and where the transistor is switched ON and OFF in synchronism with rotation of the crankshaft of an internal combustion engine are well known. Further, it is well known to sense primary winding current by a resistor that is connected in series with the primary winding and transistor and to bias the transistor into a current limiting mode when the current sensed by the resistor increases to a current-limit level.

It is an object of this invention to provide a new and improved feedback circuit that senses the voltage across the current sensing resistor and feeds this voltage back to circuitry that operates to bias the transistor that controls primary winding current into a current limiting mode. In accordance with this invention, the system has a capacitor which operates as feedback loop compensating element. The capacitor also forms part of an RC timing circuit that is operative to prevent the transistor that controls primary winding current from being switched back ON for a predetermined time period by noise signal voltages once it has been switched OFF to interrupt current flow through the primary winding. Thus, in a system made in accordance with this invention, a single capacitor operates to provide feedback loop compensation and to provide part of the RC timing circuit.

In regard to the aspect of this invention that prevents turn ON of the transistor that controls primary winding current for a predetermined time period after it has been turned OFF to interrupt primary winding current, it can be appreciated that when primary winding current is interrupted, the voltage of the primary winding increases. If the transistor is now immediately turned back ON, an excessively high current will flow through the transistor which, in conjunction with the very high collector to emitter voltage of the transistor, can cause damage to or total failure of the transistor.

In The Drawings

Figure 1B:
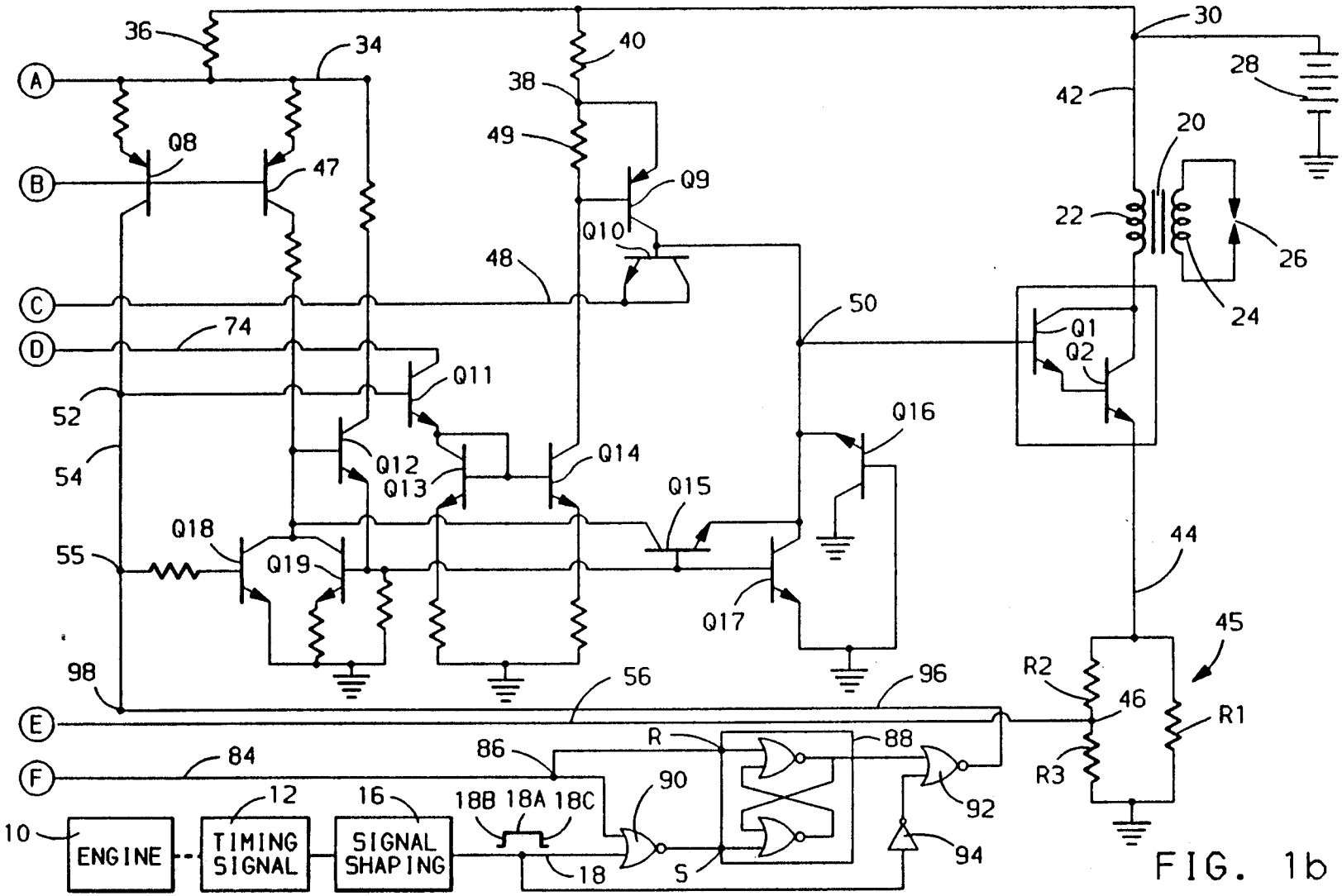

FIGS. 1*a* and 1*b* when connected together illustrate an ignition system made in accordance with this invention. In this regard, corresponding conductors terminating in the letters A, B, C, D, E and F in FIGS. 1*a* and 1*b* are connected together.

Referring to the drawings, the reference numeral 10 designates a spark ignited internal combustion engine. The crankshaft of engine 10 drives a rotor of a timing signal generator 12 which may be a known type of variable reluctance pick-up that generates voltages as a function of crankshaft angular position. The rotor, for example, may be a wheel that has circumferentially spaced slots in a manner well known to those skilled in the art. The output of the timing signal generator is applied to a signal shaping and control circuit 16 that develops a series of square-wave output pulses 18A that are applied to line 18. These square-wave voltage pulses 18A occur at predetermined angular positions of the crankshaft of engine 10 and therefore provide timing information to the ignition system. The square wave pulses 18A have a leading rising edge 18B and a falling trailing edge 18C. As will be described in more detail hereinafter, when a leading edge 18B occurs, a transistor connected in series with the primary winding of an ignition coil is biased ON and when trailing edge 18C occurs, the transistor is biased OFF to interrupt primary winding current thereby causing a voltage to be induced in that secondary winding of the ignition coil that causes a spark plug to fire. The system has known means (not illustrated) for varying the point of occurrence of edge 18C as a function of, for example, engine speed and engine manifold pressure and other engine operating parameters to thereby control spark advance in a manner that is well known to those skilled in the art.

The ignition system has an ignition coil 20 that has a primary winding 22 and secondary winding 24. The secondary winding 24 is shown connected to a spark plug 26 for engine 10. If the system has a distributor, secondary winding 26 is sequentially connected to a plurality of spark plugs by the distributor in a known manner. If the ignition system is a distributorless system, a plurality of ignition coils are required, one ignition coil for two spark plugs as is known to those skilled in the art. Thus, for example, if the engine 10 is a four cylinder engine two ignition coils are required.

The ignition system is powered by a twelve volt battery 28 on a motor vehicle. The positive side of battery 28 is connected to a junction 30 and its negative side is grounded.

Junction 30 is connected to a line or conductor 34 through resistor 36 and is connected to a junction 38 through resistor 40.

Junction 30 is connected to one side of primary winding 22 by a conductor 42. The opposite side of primary winding 22 is connected to the collectors of Darlington connected NPN transistors Q1 and Q2. The emitters of these transistors are connected to conductor 44. Connected between conductor 44 and ground is a resistive current sensing network 45 comprised of resistors R1, R2 and R3. This network has a junction 46 which develops a voltage that is a function of the amount of current passing through the primary winding 22. The resistance of resistor R1 may be about 0.035 ohms and the resistance of resistors R2 and R3 may each be about 54 ohms.

When the system is in operation, transistors Q1 and Q2 are biased ON and OFF in synchronism with the timing pulses 18A on line 18. When transistors Q1 and Q2 are biased ON, current flows through primary winding 22. When transistors Q1 and Q2 are biased OFF, the current through primary winding 22 is cut-off so that a voltage is induced in secondary winding 24 that causes spark plug 26 to fire.

When transistors Q1 and Q2 are biased ON, the voltage at junction 46 of current sensing network 45 increases from a zero level and transistors Q1 and Q2 are biased into a fully conductive saturated condition. As will be described in more detail hereinafter, when the voltage at junction 46 attains a predetermined level, transistors Q1 and Q2 are biased out of the saturated condition and into a linear current limit mode where the current through primary winding 22 and transistors Q1 and Q2 is limited to a predetermined value.

The line 34 is connected to a plurality of current mirror or current source transistors Q3–Q8 and 47 which are connected as shown.

The ignition system of this invention has an output drive circuit for biasing transistors Q1 and Q2 ON and OFF and for, at times, biasing transistors Q1 and Q2 into a current limit mode. This drive circuit comprises transistors Q9–Q18 connected as shown. Transistors Q10 and Q13 are connected to form diodes. In effect, the diode formed by Q10 is the base-emitter of Q10 with the base connected to the collector of Q9 and the emitter connected to a conductor 48. The base-collector diode of Q10 is connected in parallel with the base-emitter diode of Q10.

The base of Q1 is connected to a junction 50 and this junction is also connected to the collector of Q9 and to the collector of Q17. When Q9 is biased conductive, it supplies base drive current to Q1 causing Q1 and Q2 to be biased fully on or, in other words, to be biased into saturation. At this time Q17 is biased OFF. When Q9 is biased OFF or nonconductive there is no base drive to transistor Q1 and, accordingly, transistors Q1 and Q2 are biased OFF. At this time Q17 is biased ON.

The emitter of Q9 is connected to junction 38. A resistor 49 is connected across the emitter and base of Q9.

Resistor 49 is connected in series with the collector-emitter circuit of Q14 with the emitter of Q14 being connected to ground through a resistor. When Q14 is biased ON, Q9 is biased ON and when Q14 is biased OFF, Q9 is biased OFF.

The base of Q14 is connected to the emitter of Q11. The base of Q11 is connected to a junction 52. Junction 52 is connected to a line or conductor 54 which, as well as being more fully described hereinafter, has square-wave pulses applied thereto which are developed in synchronism with the angular position of the crankshaft of engine 10. When the voltage on conductor 54 and junction 52 is high, transistors Q11, Q13, Q14 and Q9 are biased ON causing transistors Q1 and Q2 to be biased ON. When the voltage at conductor 54 and junction 52 is low, transistors Q11, Q14 and Q9 are biased OFF causing transistors Q1 and Q2 to be biased OFF.

The purpose of transistor Q17 is to connect junction 50 to ground when Q1 and Q2 are to be biased OFF and to disconnect junction 50 from ground when transistor Q1 and Q2 are to be biased ON. Thus, the collector of Q17 is connected to junction 50 and its emitter is grounded. The base of Q17 is connected to the base of Q19 and the collector of Q19 is connected to the collector of Q18. The base of Q18 is connected to conductor 54 at junction 55 through a resistor. When the voltage on conductor 54 goes high, Q18 is biased ON causing Q12 to be biased OFF which, in turn, causes Q17 to be biased OFF. When the voltage on conductor 54 goes low, Q18 is biased OFF causing Q12 to be biased ON which, in turn, causes Q17 to be biased ON.

The voltage developed at junction 46 of current sensing resistive network 45 is fed back to an error amplifier by a line or conductor 56. Conductor 56 will have a voltage that is proportional to the current passing through primary winding 22. The error amplifier comprises transistors Q20–Q28 connected as shown. Transistors Q26, Q27 and Q28 are connected as diodes and form a string of series-connected diodes connected between the collector of Q25 and ground.

Transistors Q20 and Q21 form part of a voltage reference developing circuit which develops a substantially constant reference voltage at the emitter of Q21 which is applied to the base of Q22. The emitter of Q22 is connected to junction 58 which, in turn, is connected to line 56. Accordingly, the feedback voltage from junction 46 is applied to the emitter of Q22. A capacitor 60, the purposes of which will be described hereinafter, is connected between junction 58 and a junction 62. Capacitor 22 may have a capacitance of about 0.022 microfarads.

The collector of Q22 is connected to a junction 64 through a resistor R4 which may have a resistance of about 12K ohms.

The collector of Q22 is connected to the base of Q23. The emitter of Q23 is connected to the base of Q24 and to the base of Q25. A resistor R5, which may have a resistance of about 150 ohms, is connected between junction 64 and a junction 66. Junction 66 is connected to a line or conductor 68 and is connected to junction 62 by conductor 70. Junction 64 is connected to line 48.

The collector of Q25 is connected to the collector of Q11 through a resistor 72 and conductor 74.

The system of this invention has a voltage comparator comprised of transistors Q29–Q34. The base of Q29 is connected to a junction 80 which is connected to the collector of Q7 and to ground through a resistor R6. The voltage at junction 80 is substantially constant and provides a reference voltage for the comparator which is applied to one input of the comparator, namely the base of Q29.

The other input to the voltage comparator is the base of Q32 which is connected to conductor 68. The output of the voltage comparator at junction 82 is connected to a conductor 84. The voltage comparator compares the constant voltage at junction 82 with a variable voltage on conductor 68 in a manner to be more fully described hereinafter.

The conductor 84 is connected to a junction 86. Junction 86 is connected to the reset input R of an SR flip-flop 88 and to one input of a NOR gate 90. SR flip-flop 88 is comprised of two NOR gates that are connected as shown. The other input to gate 90 is connected to conductor 18. The output of gate 90 is connected to the set input S of flip-flop 88. The output of flip-flop 88 is connected to one input of another NOR gate 92. The other input of gate 92 is connected to conductor 18 by an inverter 94. The output of NOR gate 92 is connected to a conductor 96 which, in turn, is connected to junction 98. Junction 98 is connected to conductor 54.

The operation of the ignition system of this invention will now be described beginning with a description of the current limit feedback operation.

Let it be assumed that the signal voltage on line 54 has gone high. When this happens, transistors Q1 and Q2 are biased fully conductive, that is, they are biased into saturation. Current now starts to build-up or increase through primary winding 22 and this current is sensed by resistive current sensing network 45. As current increases, the voltage at junction 46 increases. When the current reaches a current limit value of, for example 9 amps, transistors Q1 and Q2 are biased into a current limiting mode where primary current is limited and maintained at a level of 9 amps.

When the current approaches the desired level of 9 amps, the voltage applied to the emitter of Q22 from junction 46 increases which reduces the conduction of Q22. When the conduction of Q22 is reduced or decreases the base current drive to transistors Q23, Q24 and Q25 is increased. Transistor 24 now conducts more current tending to shunt some of the collector current of Q9 away from the base of Q1. Further, the increased conduction of Q25 reduces the amount of current conducted by Q11 which, in turn, reduces the amount of current conducted by Q14. Reduced current conduction of Q14 results in a reduced current conduction of Q9 which, in turn, decreases the base current drive to Q1. The net effect of what has been described is that the system reduces the base current drive to Q1 to a level that causes transistors Q1 and Q2 to be biased into a current limit mode. Capacitor 60, which is connected between junctions 58 and 62, provides feedback loop phase-gain compensation as is required for stable current limit operation. The primary effect for placing the system in the current limit mode is the reduced current conduction of Q14.

The system of this invention prevents transistors Q1 and Q2 from being biased ON by spurious noise signal voltages for a predetermined time period once these transistors have been biased OFF to interrupt the current flowing through primary winding 22. The manner in which this is accomplished will now be described.

The capacitor 60 and resistor R4 form an RC timing circuit. Capacitor 60 can be fully charged through a circuit that can be traced from the collector of Q9, through Q10 acting as a diode to line 48, through line 48, resistor R5 and line 70 to one side of capacitor 60, and then from the opposite side of capacitor 60 to ground through line 56 and the low resistance of resistor R3 in parallel with resistors R2 and R1. The charging circuit is only active when transistor Q9 is biased ON. Thus, capacitor 60 is charged when transistors Q9 and Q1 and Q2 are biased ON and the action that has been described begins when the signal voltage on line 54 goes high. The voltage to which capacitor 60 is charged is substantially equal to the voltage of the collector of Q9 less the small voltage drop across the base-emitter of Q10.

The capacitor voltage on capacitor 60 is applied to one input (base of Q32) of the voltage comparator. As the capacitor 60 charges, the voltage at the base of Q32 increases and when it exceeds the reference voltage at the base of Q29, the output of the voltage comparator on line 84 goes from high to low. The voltage on line 84 remains low until the voltage at the base of Q32 drops below the reference voltage on the base of Q29 which will occur after the capacitor 60 is allowed to discharge in a manner to be described.

When the voltage on line 54 goes from high to low, transistors Q9, Q1 and Q2 are biased OFF. This opens the charging circuit for capacitor 60 and interrupts the current path for primary winding 22 causing a voltage to be induced in secondary winding 24 to fire spark plug 26. Capacitor 60 now starts to discharge through resistors R5 and R4 and conducting transistor Q22. As capacitor 60 discharges, the voltage at the base of Q32 decreases as a function of the RC time constant defined by the resistance of resistors R4 and R5 and the capacitance of capacitor 60. When the capacitor 60 has discharged to a level where the voltage at the base of Q32 drops below the reference voltage on the base of Q29, the comparator output at line 84 goes from low to high. The time required for capacitor 60 to discharge to a level which causes the voltage comparator to switch from low to high is a predetermined time period and may be called a "timing period". This timing period starts when the signal on line 54 goes from high to low and terminates when the voltage on capacitor 60, due to discharge, drops below the reference voltage.

When drive signal 18A is low and the signal on line 84 is low, flip-flop 88 is set by a signal applied to its set terminal S from NOR gate 90. The voltage on line 84 is low whenever the voltage on capacitor 60 is higher than the reference voltage at the base of Q32. The voltage on line 84 will always go low when capacitor 60 has been charged by conduction of Q9. Q9 is biased ON when transition 18B occurs. When the signal voltage 18A on line 18 goes from low to high (transition 18B) the output of inverter 94 which is applied to NOR gate 92 goes low which causes the output of NOR gate 92 to go high. With the output of NOR gate 92 high, the voltage on line 54 is high which causes transistors Q1 and Q2 to be biased ON. At this time, the signal voltage on line 84 is low since capacitor 60 is charged as soon as transistors Q9 and Q1 and Q2 are biased ON.

When signal transition 18C occurs, the logic circuitry 88, 90, 92 and 94 causes the output of NOR gate 92 to go from high to low. At this time, the signal voltage on line 84 is still low. When the output of gate 92 goes low, the voltage on line 54 goes low and transistors Q1 and Q2 are biased OFF. At this time, any noise voltage on line 18, for example, a noise voltage that might cause a transition like transition 18A that might occur subsequent to transition 18C cannot now cause transistors Q1 and Q2 to be turned back ON, thereby protecting Q1 and Q2 from damage. Thus, the flip-flop 88 has been set to such a state that any low to high transition on line 18 after the high to low transition of 18C occurs will not cause transistors Q1 and Q2 to be biased ON. When the timing period expires, that is, when the capacitor 60 has discharged to a point where the voltage on line 68 is less than the voltage at the base of Q29, the voltage on line 84 goes from low to high which resets flip-flop 88 such that subsequent transitions 18B and 18C will now cause corresponding voltage transitions on line 54. Thus, for the timing period between a transition 18C and the point in time that the voltage on line 84 goes from low to high, transistors Q1 and Q2 cannot be biased ON. Putting it another way, the logic circuitry (88, 90, 92 and 94) cause the output of gate 92 to remain low for the time of the timing period.

It can be appreciated that the system of this invention has a closed feedback loop in regard to the current limiting function of the circuit. Thus, the signal at junction 46 is fed back to the error amplifier which, in turn, controls the amount of current conducted by Q9 which results in the control of the amount of current conducted by Q1 and Q2. The capacitor 60 provides a feedback compensation element for the closed feedback loop which insures stability of operation of the closed feedback loop.

The single capacitor 60 provides feedback loop compensation and is part of the RC timing circuit. Since the feedback loop is not in use during the time that RC timing function is needed, and vice-versa, using the capacitor 60 for one function in no way interferes with the behavior of the other function.

The comparator input circuitry operates such that it will not disrupt normal operation of the error amplifier when it is active, nor will it abnormally affect the expected decay time constant of the RC combination. The diode provided by Q10 provides isolation of the error amplifier from the drive line junction 50 when it is at a low (non-driving) voltage.

The embodiments of the invention in which an exclusive property or privilege is claimed are defined as follows:

1. An ignition system for a spark-ignited internal combustion engine, comprising in combination, means coupled to the crankshaft of said engine for developing a series of timing pulses, an ignition coil having a primary winding and a secondary winding, means connecting said secondary winding to a spark plug, a semiconductor switching means connected in series with said primary winding, said semiconductor switching means being biased ON and OFF in response to said timing pulses, current sensing resistor means connected in series with said semiconductor switching means and in series with primary winding for developing a current limit signal voltage that is a function of the amount of current passing through said primary winding, an error amplifier, a feedback circuit for applying said current limit signal to said error amplifier comprising a capacitor that is operative to provide feedback loop compensation, means coupled to said semiconductor switching means and to the output of said error amplifier for causing said semiconductor switching means to be biased into a current limit mode which limits the amount of current passing through said primary winding and semiconductor switching means when said current limit signal voltage attains a predetermined value and means for preventing said semiconductor switching means from being biased ON for a predetermined time period after it has been biased OFF, said last named means comprising an RC timing circuit which includes said capacitor and a resistance.

2. The ignition system according to claim 1 where said semiconductor switching means comprises at least one NPN transistor having its collector connected to said primary winding and its emitter connected to said current sensing resistor means.

3. The ignition system according to claim 1 where the timing function provided by said RC timing circuit is provided by discharging said capacitor through said resistance.

* * * * *